US006978918B2

(12) United States Patent
Scanlan et al.

(10) Patent No.: US 6,978,918 B2
(45) Date of Patent: Dec. 27, 2005

(54) TETHER FOR OBJECT SUCH AS INFANT DRINKING DEVICE

(75) Inventors: Karla A. Scanlan, Bloomfield Hills, MI (US); Karen A. Kuhn, Elmwood Park, IL (US)

(73) Assignee: Twin Beginnings, LLC, Bloomfield Hills, MI (US)

( * ) Notice: Subject to any disclaimer, the term of this patent is extended or adjusted under 35 U.S.C. 154(b) by 55 days.

(21) Appl. No.: 10/320,917

(22) Filed: Dec. 17, 2002

(65) Prior Publication Data

US 2003/0121944 A1 Jul. 3, 2003

Related U.S. Application Data

(60) Provisional application No. 60/341,303, filed on Dec. 18, 2001.

(51) Int. Cl.[7] ..... A45F 3/16

(52) U.S. Cl. ..... 224/148.6; 224/250; 224/409; 224/563; 224/572

(58) Field of Search ..... 224/148.6, 148.5, 224/250, 409, 563, 572; 248/102, 104

(56) References Cited

U.S. PATENT DOCUMENTS

| | | | | |
|---|---|---|---|---|
| 1,385,085 | A | 7/1921 | Mahoney | |
| 2,303,728 | A | 12/1942 | Drayton et al. | |
| 2,457,972 | A | 1/1949 | Bailey | |
| 2,539,698 | A * | 1/1951 | Pearson | 248/104 |
| 3,947,927 | A | 4/1976 | Rosenthal | |
| 3,994,048 | A | 11/1976 | Rosenthal | |
| 4,096,977 | A | 6/1978 | Barville et al. | |
| D305,961 | S * | 2/1990 | Cobb | D3/228 |
| 4,946,119 | A | 8/1990 | Hellhake | |
| 5,083,692 | A * | 1/1992 | Treese | 224/615 |
| 5,104,076 | A | 4/1992 | Goodall, Jr. | |
| 5,265,834 | A * | 11/1993 | Daniels | 248/104 |
| D356,379 | S | 3/1995 | Ibinger | |
| D358,892 | S | 5/1995 | Kahn | |
| 5,582,337 | A | 12/1996 | McPherson et al. | |
| 5,702,039 | A | 12/1997 | Olaiz | |
| 5,806,730 | A | 9/1998 | Deno | |
| 5,855,306 | A * | 1/1999 | Masak | 224/250 |
| 5,873,551 | A * | 2/1999 | Jones | 248/102 |
| D413,984 | S | 9/1999 | Lindsey | |
| 5,957,515 | A * | 9/1999 | Van Der Sluys | 294/25 |
| 6,138,882 | A | 10/2000 | Buettner | |
| 6,209,765 | B1 | 4/2001 | King | |

OTHER PUBLICATIONS

International Search Report dated Mar. 27, 2003 for International Application No. PCT/US02/40181 dated Dec. 17, 2002 entitled "Tether For Object Such As Infant Drinking Device," (4 pages).

* cited by examiner

*Primary Examiner*—Stephen K. Cronin
(74) *Attorney, Agent, or Firm*—Patzik, Frank & Samotny Ltd.

(57) ABSTRACT

A tether that addresses the above and other deficiencies in the art, that is efficient to manufacture, and attractive in use. More specifically, the invention is directed to a tether including a ring, a first strap connected to the ring at a first point, a second strap coupled to one of the first strap and ring, and a releasable connector. The releasable connector is operable to releasably couple the first strap to the ring at a second point such that the first strap forms a variable sized opening for receiving an object or container. The invention is also directed to a tethered container assembly including the aforementioned tether and a container.

29 Claims, 2 Drawing Sheets

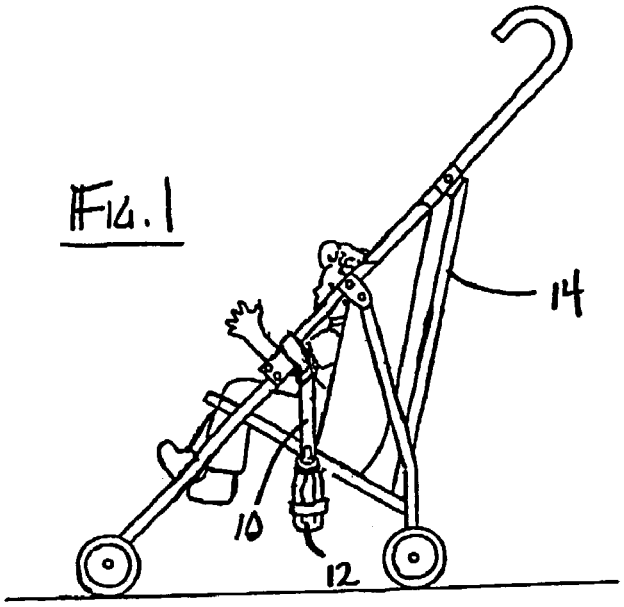
FIG. 1
FIG 2
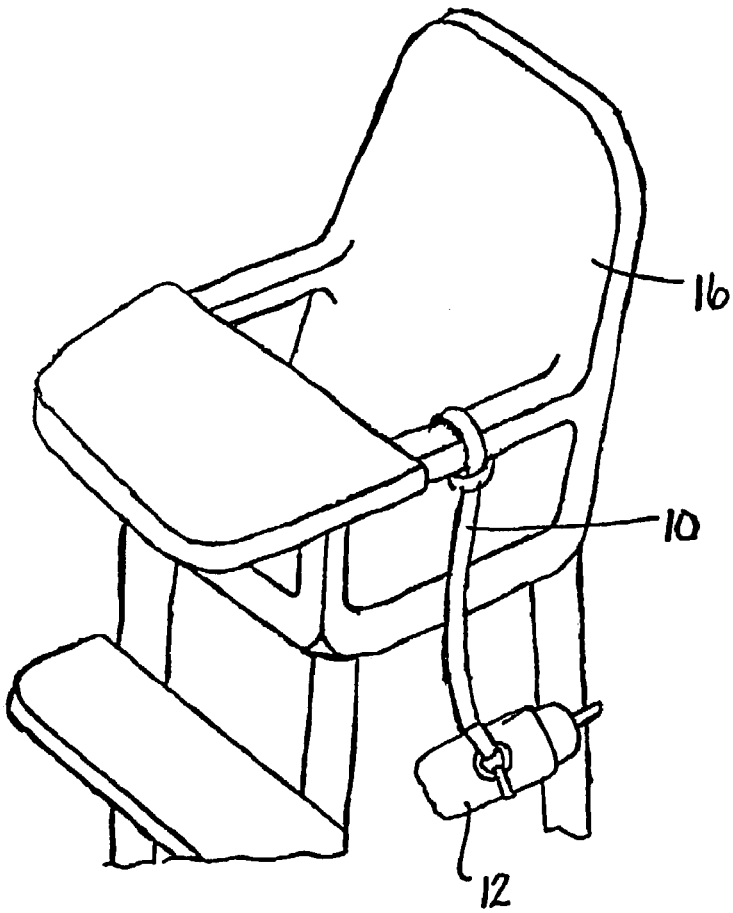

TETHER FOR OBJECT SUCH AS INFANT DRINKING DEVICE

CROSS-REFERENCE TO RELATED APPLICATION

This application claims the benefit of U.S. Provisional Application No. 60/341,303, filed Dec. 18, 2001, the entire disclosure of the application is considered part of the disclosure of this application and is hereby incorporated by reference.

BACKGROUND OF THE INVENTION

The present invention generally relates to a tether for an object and, more particularly, to a tether for a baby bottle, sippy cup, and the like.

Infants have difficulty maintaining a grasp on drinking or feeding bottles. Some infants are also inclined to drop or throw their feeding bottles causing inconvenience to others and embarrassment to parents. In either instance, a dropped bottle can hit dirty floors, sidewalks, or streets causing dirt, debris, or other contaminants to accumulate on the bottle. Further, bottles or cups dropped by an infant can be lost by an unwary parent, particularly during outdoor activities.

While parents have had to deal with the inconvenience of repeatedly picking up and cleaning dropped or thrown bottles and sippy cups for some time, convenient and efficiently designed tethers or straps are not readily available. For example, some commercially distributed tethers or straps do not permit the tether to accommodate a variety of bottle and cup sizes. Others require complex steps to couple the tether to the bottle or cup. Still others do not permit the tether to be easily held by the parent or guardian while also permitting efficient coupling to an object such as a stroller or high-chair.

SUMMARY OF THE INVENTION

The present invention is generally directed to a tether that addresses the above and other deficiencies in the art, that is efficient to manufacture, and attractive in use. More specifically, the invention is directed to a tether including a ring, a first strap connected to the ring at a first point, a second strap coupled to one of the first strap and ring, and a releasable connector. The releasable connector is operable to releasably couple the first strap to the ring at a second point such that the first strap forms a variable sized opening for receiving an object or container. The invention is also directed to a tethered container assembly including the aforementioned tether and a container.

Further scope of applicability of the present invention will become apparent from the following detailed description, claims, and drawings. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detailed description given here below, the appended claims, and the accompanying drawings in which:

FIG. 1 illustrates the tether of the present invention coupling a bottle to a stroller;

FIG. 2 illustrates the tether of the present invention coupling a bottle to a high-chair;

DETAILED DESCRIPTION OF THE PREFERRED EMBODIMENT

The tether 10 of the present invention is illustrated in FIGS. 1 and 2 as coupling a bottle 12 to a stroller 14 and high-chair 16, respectively. However, those skilled in the art will appreciate that the tether 10 may be used to couple other feeding or drinking devices, such as sippy cups and the like, to other objects.

Figure 3:
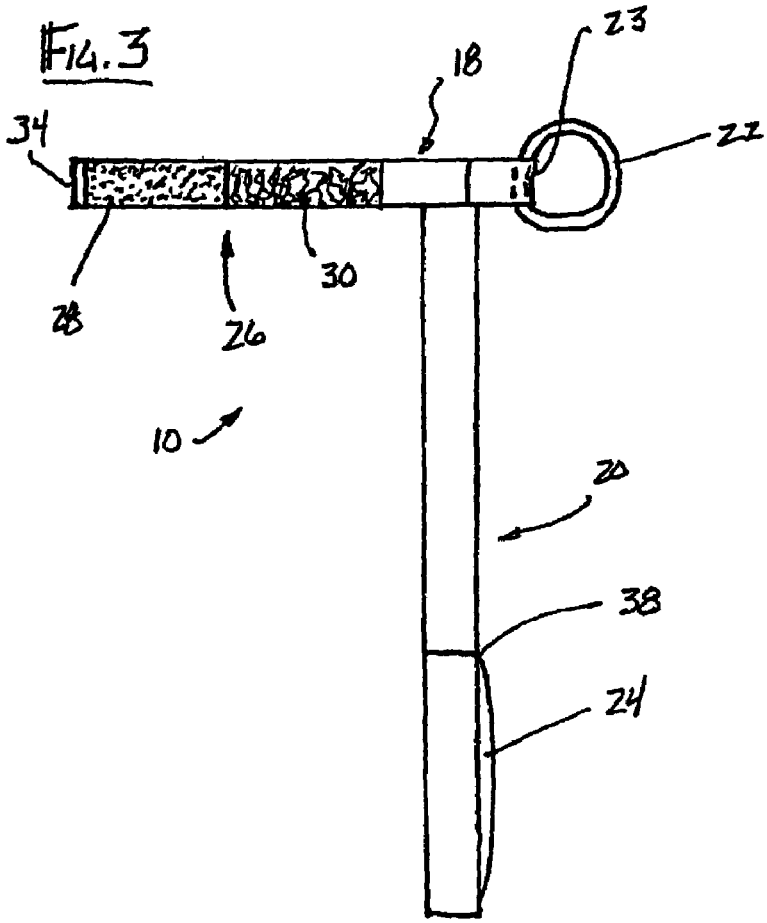
FIG. 3 is a side elevational view of the tether of the present invention.
Figure 4:
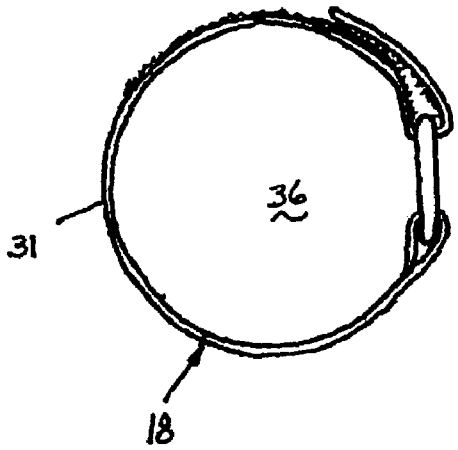
FIG. 4 is a top plan view of the first strap of the tether forming an adjustable opening for a bottle or cup.

With reference to FIGS. 3 and 4, the tether 10 generally includes first and second straps 18 and 20 made of a flexible material such as cloth, polyester, or the like. While the described embodiment of the invention contemplates the use of straps which are made of a substantially non-resilient or non-elastic material, resilient materials may be used to increase the gripping force on the feeding or drinking device or other object.

The tether 10 also includes a ring 22 coupled to a first end 23 of the first strap 18. The ring 22 is preferably made of plastic and has a circular configuration though other materials and configurations may be used without departing from the scope of the invention as defined by the appended claims. By way of example rather than limitation, the ring may have a rectangular or semi-circular configuration. To facilitate ease of coupling of the first strap 18 to the bottle or cup, the first strap is provided with a releasable connector 26 which, in the preferred embodiment, includes adjacent segments of Velcro™ hooks 28 and loops 30. The hooks 28 and loops 30 are included on a first side 31 (FIG. 4) of the first strap 18, preferably adjacent or proximate a second end 34 of strap 18, to provide a releasable coupling with the ring 22. The first strap 18 can be manipulated to pass at least a portion of the releasable connector 26 through the ring 22 and connect the strap to a second point on the ring to provide an opening 36 of variable size and configuration for coupling the tether to a baby bottle or other container or object.

The second strap 20 includes a loop 24 that may be used for maintaining a firm grasp on the tether or to couple the tether to a stroller, highchair, etc. The loop is formed by folding the second strap back such that the end 38 thereof may be coupled to the body of the second strap. The loop 24 is preferably sized to permit an adult's hand to pass through the loop or otherwise allow the parent or guardian to maintain a firm grasp on the tether. When it is desirable to couple the tether to an object, such as the illustrated stroller or high-chair, the second strap 20 may be wrapped about the frame of the object and the first strap 18, either with or without the bottle or cup attached, may then be passed through the loop 24 to provide a secure connection to the stroller, high-chair, or other object.

As is shown in FIGS. 3 and 4, the second strap 20 is fixed, such as by stitching, to the first strap 18 between the releasable connector 26 and the ring 22 and is oriented generally perpendicular to the first strap 18. This arrangement permits the first strap to be efficiently coupled to a bottle or cup of varying diameter without negatively impacting the efficiency by which the tether may be coupled to the stroller, high-chair, or the like. Thus, the invention may be used with bottles, cups, strollers, and high-chairs of different manufacturers. Moreover, while the variable sized opening 36 is illustrated as a generally circular opening for similarly configured bottles or cups, the invention is equally applicable for differently configured bottles or cups including rectangular or stylized designs. Additionally, the tether is not limited to coupling to a specific portion of the bottle or cup.

Notwithstanding the specific embodiment of the invention illustrated in the attached drawings and described above, a variety of modifications may be made to the invention. For example, a clip or other attachment device may be coupled to the second strap 20 either in addition to or in lieu of the loop 24. Further, the second strap 20 may be coupled directly to the ring 22 rather than to the first strap 18. These alternative embodiments are offered by way of completeness rather than limitation as those skilled in the art will appreciate that other modifications may also be made.

The foregoing discussion discloses and describes an exemplary embodiment of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. A tether comprising:

a ring;

a first strap connected to the ring at a first point;

a second strap having first and second ends with the first end oriented adjacent to the first strap and being directly attached to one of the first strap and ring, said second strap comprising a length section substantially spanning from the first end to the second end of the second strap, the second end of the second strap being folded back and attached to the length section so as to form a loop handle, the loop handle being positioned proximate an end of said length section and defining an interior region capable of receiving said first strap and said ring therethrough to attach the tether to a second object;

and a releasable connector operable to releasably couple the first strap to the ring at a second point such that the first strap forms a variable sized opening for receiving an object.

2. The tether of claim 1 wherein the second strap has a body and an end, the end being coupled to the body to form a loop.

3. The tether of claim 1 wherein said first and second straps consist of a flexible material.

4. The tether of claim 1 wherein said second strap is oriented substantially perpendicular to the first strap.

5. The tether of claim 1 wherein the releasable connector is fixed to the first strap.

6. The tether of claim 5 wherein the second strap is connected to the first strap between the releasable connector and the ring.

7. The tether of claim 5 wherein the releasable connector includes a hook segment and a loop segment, one of the hook and loop segments being passable through the ring and engageable with the other of the hook and loop segments.

8. The tether of claim 5 wherein said first strap includes a first side and said releasable connector is fixed to said first side.

9. The tether of claim 8 wherein said releasable connector includes a hook segment and a loop segment, one of the hook and loop segments being passable through the ring and engageable with the other of the hook and loop segments.

10. A tether comprising:

a ring;

a first strap connected to the ring at a first point, the first strap having a first side and a releasable connector fixed to the first side, the releasable connector being operable to releasably couple the first strap to the ring at a second point such that the first strap forms a variable sized opening for receiving an object; and a second strap oriented substantially adjacent to the first strap and being directly attached to one of the first strap and ring at a first end, said second strap comprising a length section substantially spanning from the first end to a second end of the second strap, the second end of the second strap being folded back and attached to the length section so as to form a loop handle, said loop handle being positioned proximate an end of said length section and defining an interior region capable of receiving said first strap and said ring therethrough to attach the tether to a second object.

11. The tether of claim 10 wherein the second strap is connected to the first strap between the releasable connector and the ring.

12. The tether of claim 10 wherein the releasable connector includes a hook segment and a loop segment, one of the hook and loop segments being passable through the ring and engageable with the other of the hook and loop segments.

13. The tether of claim 10 wherein the second strap has a body and an end, the end being coupled to the body to form a loop.

14. The tether of claim 10 wherein the second strap is oriented substantially perpendicular to the first strap.

15. A tethered container assembly comprising:

a container;

a tether having a ring, a first strap connected to the ring at a first point, a second strap oriented substantially adjacent to the first strap and being directly attached to one of the first strap and ring at a first end of the first strap, said second strap comprising a length section substantially spanning from the first end to a second end of the second strap, the second end of the second strap being folded back and attached to the length section so as to form a loop handle, said loop handle being positioned proximate an end of said length section and defining an interior region thereof capable of receiving said first strap and said ring therethrough to attach the tether to an object, and a releasable connector coupling the first strap to the ring at a second point such that the first strap forms a variable sized opening surrounding a portion of the container to secure the container to the tether.

16. The tether of claim 15 wherein the second strap has a body and an end, the end being coupled to the body to form a loop.

17. The tether of claim 15 wherein said first and second straps consist of a flexible material.

18. The tether container assembly of claim 15 wherein the second strap is oriented substantially perpendicular to the first strap.

19. The tethered container assembly of claim 15 wherein the releasable connector is fixed to the first strap.

20. The tether of claim 19 wherein the second strap is connected to the first strap between the releasable connector and the ring.

21. The tether of claim 19 wherein the releasable connector includes a hook segment and a loop segment, one of the hook and loop segments being passable through the ring and engageable with the other of the hook and loop segments.

22. The tether of claim 19 wherein said first strap includes a first side and said releasable connector is fixed to said first side.

23. The tether of claim 22 wherein said releasable connector includes a hook segment and a loop segment, one of the hook and loop segments being passable through the ring and engageable with the other of the hook and loop segments.

24. A method of using a tether holding a first object to a second object comprising the steps of:

attaching a first strap of the tether, having first and second ends and a length section, to a ring at the first end of the first strap;

forming a variable sized opening from the first strap for securely receiving the first object;

orienting a second strap, having first and second ends and a length section therebetween, with the length section being substantially adjacent to the first strap;

directly attaching the first end of the second strap to one of the first strap or the ring at the first end of the second strap;

folding back the second end of the second strap so as to form a loop handle;

attaching the second end of the second strap to the length section so as to form a loop handle with an interior region capable of receiving the first strap and the ring through the interior region of the loop handle; and, passing the first strap and ring through the interior region of the loop handle so as to attach the tether to a second object.

25. The method of using a tether of claim 24 wherein the second strap is oriented substantially perpendicular to said first strap.

26. The method of using a tether of claim 24 wherein the step of forming a variable sized opening comprises the step of extending the second end of the first strap through the ring and releasably attaching it to the length section of the first strap.

27. A method of using a tether for holding a first object and attaching it to a second object comprising the steps of:

attaching a first strap of the tether, having first and second ends and a length section, to a ring at the first end of the first strap;

forming a variable sized opening from the first strap for securely receiving the first object;

orienting a second strap of the tether, having first and second ends and a length section therebetween, with the second strap length section being aligned substantially perpendicular to the first strap, wherein the second strap has a loop handle with an interior region at its second end capable of receiving the first strap and the ring through the interior region of the loop handle;

directly attaching the first end of the second strap to one of the first strap or the ring;

placing the first object within the variable sized opening;

adjusting the position of the second end of the first strap with the first strap length section to adjust the size of the variable sized opening so that the first object is held by the first strap; and, passing the first strap and ring through the interior region of the loop handle so as to attach the tether to a second object.

28. The method of using a tether of claim 27 wherein the step of forming a variable sized opening comprises the step of extending the second end of the first strap through the ring and release ably attaching it to the length section of the first strap.

29. A method of using a tether having a first end, a second end having a loop handle with an interior region, and a length section therebetween, to hold a first object at the first end of the tether and attach it to a second object at the second end of the tether comprising the steps of:

passing the length section around a portion of the second object;

passing the first end of the tether through the interior region of the loop handle so as to substantially surround the second object with the length section;

placing the first object within a variable sized opening of a releasable closure of the first end for securely holding the first object therein; and, adjusting the releasable closure about the first object so as to retain the first object at the first end of the tether.

* * * * *